US009786424B2

(12) United States Patent
Park et al.

(10) Patent No.: US 9,786,424 B2
(45) Date of Patent: Oct. 10, 2017

(54) COIL COMPONENT

(71) Applicant: SAMSUNG ELECTRO-MECHANICS CO., LTD., Suwon-Si, Gyeonggi-Do (KR)

(72) Inventors: Seung Wook Park, Suwon-Si (KR); Won Chul Sim, Suwon-Si (KR); Kwang Mo Kim, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/936,550

(22) Filed: Nov. 9, 2015

(65) Prior Publication Data

US 2016/0155557 A1 Jun. 2, 2016

(30) Foreign Application Priority Data

Dec. 2, 2014 (KR) ..... 10-2014-0170570

(51) Int. Cl.
*H01F 27/24* (2006.01)
*H01F 5/00* (2006.01)
*H01F 17/00* (2006.01)

(52) U.S. Cl.
CPC ..... *H01F 17/0033* (2013.01); *H01F 17/0013* (2013.01)

(58) Field of Classification Search
CPC ..... H01F 27/263; H01F 27/323; H01F 27/26; H01F 27/32; H01F 27/2804; H01F 17/0033; H01F 17/0013
USPC ..... 336/200, 223, 233
See application file for complete search history.

(56) References Cited

U.S. PATENT DOCUMENTS 8,471,668 B2 * 6/2013 Hsieh ..... H01F 17/0013 336/200
2006/0001520 A1 1/2006 Kaji et al.
2008/0238602 A1 * 10/2008 Schrom ..... H01F 17/0006 336/84 M
2010/0157565 A1 * 6/2010 Yoshida ..... H01F 27/292 361/811
2011/0133875 A1 * 6/2011 Chiu ..... H01F 17/0013 336/200
2013/0234820 A1 * 9/2013 Yoo ..... H01F 17/0013 336/200

(Continued)

FOREIGN PATENT DOCUMENTS

JP 2006-019506 A 1/2006
JP 2007-242800 A 9/2007
JP 2010-212632 A 9/2010

(Continued)

OTHER PUBLICATIONS

Korean Office Action dated Oct. 2, 2015, issued in corresponding Korean Patent Application No. 10-2014-0170570. (w/ English translation).

*Primary Examiner* — Mangtin Lian
(74) *Attorney, Agent, or Firm* — McDermott Will & Emery LLP

(57) ABSTRACT

A coil component includes an insulating layer in which coil conductors are embedded, and a magnetic member disposed on one surface of the insulating layer and having a magnetic core protruding therefrom. The magnetic core is inserted into the insulating layer and has a width which is increased toward a lower portion thereof.

9 Claims, 3 Drawing Sheets

(56) References Cited

U.S. PATENT DOCUMENTS

| | | | | |
|---|---|---|---|---|
| 2014/0062615 | A1 | 3/2014 | Yoo et al. | |
| 2014/0176283 | A1* | 6/2014 | Yang | H01F 41/046 336/200 |

FOREIGN PATENT DOCUMENTS

| | | | |
|---|---|---|---|
| JP | 4793661 | B2 | 10/2011 |
| JP | 2012-119373 | A | 6/2012 |
| JP | 2012-234869 | A | 11/2012 |
| KR | 10-2013-0104034 | A | 9/2013 |
| KR | 10-2014-0028450 | A | 3/2014 |
| KR | 10-2014-0061812 | A | 5/2014 |

* cited by examiner

COIL COMPONENT

CROSS-REFERENCE TO RELATED APPLICATION

This application claims the benefit of priority to Korean Patent Application No. 10-2014-0170570 filed on Dec. 2, 2014, with the Korean Intellectual Property Office, the disclosure of which is incorporated herein by reference.

BACKGROUND

The present disclosure relates to a coil component, and more particularly, to a coil component having an improved fixing strength.

Electronic devices such as portable phones, home appliances, personal computers (PCs), personal digital assistants (PDAs), liquid crystal displays (LCDs), navigation systems, and the like have been gradually digitalized with faster speeds. Since these electronic devices are sensitive to external stimulation, there occurs a case in which a small abnormal voltage and high frequency noise externally flow into an internal circuit of the electronic device, and, subsequently, a circuit may be damaged or a signal may be distorted.

The causes of the abnormal voltage and noise may include a switching voltage generated in the circuit, a power noise included in a power supply voltage, unnecessary electromagnetic signals or noises, or the like. To prevent the abnormal voltage and high frequency noise from flowing into the circuit, a coil component has widely been used.

In particular, high speed interfaces, for example, universal serial buses (USBs) 2.0, USBs 3.0, and high-definition multimedia interface (HDMI) have adopted a differential signal system that transmits differential signals (differential mode signals) using a pair of signal lines, unlike a general single-end transmission system. Thus, the differential signal transmission system uses a common mode filter (CMF) for removing common mode noise.

In general, coil components including CMFs have a structure in which magnetic layers, which are movement paths of a magnetic flux, are stacked on upper and lower portions of an insulating layer including coil conductors. In this case, adhesion between the insulating layer and the magnetic layer becomes a problem due to a difference of materials used for each.

That is, since the magnetic layer is formed of ferrite, adhesion between the insulating layer and the magnetic layer depends only on the adhesive property of a polymer resin, which is a material forming the insulating layer. As a result, the magnetic layer may often be separated from the insulating layer through mild shocks during a manufacturing process or at the time when a substrate is mounted.

SUMMARY

An aspect of the present disclosure may provide a coil component capable of increasing reliability of a product by structurally preventing separation of a magnetic layer.

According to an aspect of the present disclosure, a coil component may include an insulating layer in which coil conductors are embedded, and a magnetic member disposed to be in contact with one surface of the insulating layer and having a magnetic core protruding from the magnetic member. The magnetic core may be inserted into the insulating layer and have a width which is increased toward the other surface of the insulating layer.

A lower width of the magnetic core may be greater than an upper width of the magnetic core, and thus the magnetic core may have a trapezoidal shape in which a diameter of the magnetic core is increased toward a lower portion, in particular, toward the inside of the insulating layer. Thus, the magnetic core may serve as an anchor to structurally prevent separation of the magnetic member.

In order to complement the number of coil turns of the coil conductors reduced due to the magnetic core having the anchor structure, the number of coil turns of the coil conductor disposed on an upper layer, for example, the coil conductor which are close to the magnetic member may be greater than the number of coil turns of the coil conductor disposed on a lower layer.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
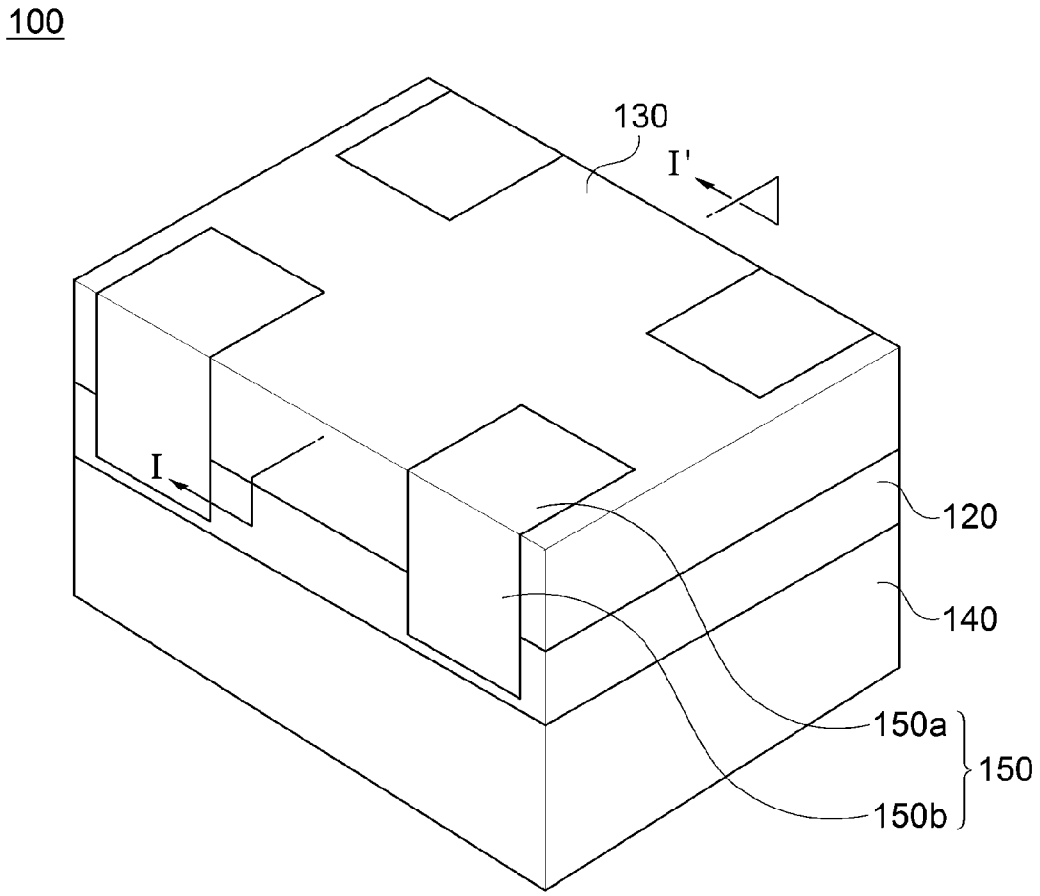
FIG. 1 is a perspective view of a coil component according to the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
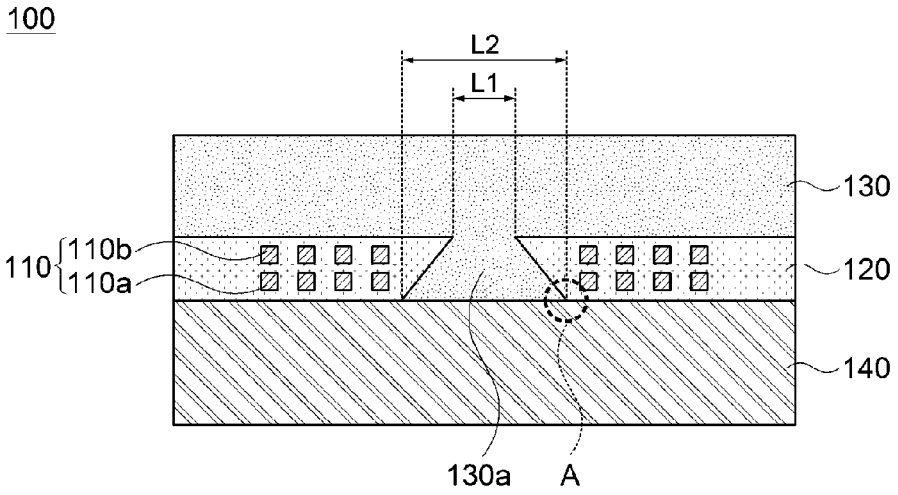
FIG. 2 is a cross-sectional view taken along line I-I' of FIG. 1.

FIG. 1 is a perspective view of a coil component according to an exemplary embodiment and FIG. 2 is a cross-sectional view taken along line I-I' of FIG. 1.

Referring to FIGS. 1 and 2, a coil component 100, according to the exemplary embodiment, may include an insulating layer 120 in which coil conductor 110 is embedded, a magnetic member 130 disposed on one surface of the insulating layer 120, and a magnetic substrate 140 disposed on the other surface of the insulating layer 120.

The magnetic substrate 140, a substrate formed in an approximately rectangular parallelepiped shape, may support the insulating layer 120 and the magnetic member 130. Thus, the coil component 100, according to the exemplary embodiment, may be formed in a structure in which the magnetic substrate 140 is disposed on the lowest portion, and the insulating layer 120 and the magnetic member 130 are sequentially stacked on the magnetic substrate 140.

The magnetic substrate 140 may serve as a movement path of magnetic flux generated from the coil conductor 110 at the time of applying current, in addition to a role as the above-mentioned supporting member.

Thus, the magnetic substrate 140 may be formed of any magnetic material as long as it may obtain predetermined inductance. For example, for a material forming the magnetic substrate 140, a nickel (Ni) based ferrite material containing $Fe_2O_3$ and NiO as main components, an N—Zn based ferrite material containing $Fe_2O_3$, NiO, and ZnO as main components, a Ni—Zn—Cu based ferrite material containing $Fe_2O_3$, NiO, ZnO, and CuO as main components, or the like may be used.

The insulating layer 120, a polymer resin layer surrounding the coil conductor 110, may serve to insulate between patterns of the coil conductor 110 and protect the coil conductor 110 from external factors.

Thus, the insulating layer 120 may be formed of a polymer resin having superior thermal resistance, moisture resistance, and superior insulating properties. Examples of an optimal material forming the insulating layer 120 may include an epoxy resin, a phenol resin, a urethane resin, a silicon resin, a polyimide resin, or the like.

The coil conductor 110, metal lines having coil patterns plated in a spiral shape, may be formed of at least one metal selected from the group consisting of silver (Ag), palladium (Pd), aluminum (Al), nickel (Ni), titanium (Ti), gold (Au), copper (Cu), or platinum (Pt) having superior electrical conductivity.

The coil conductor 110 may be constituted in a multilayer of two layers or more. For example, as illustrated in the drawings, the coil conductor 110 may include a first coil conductor 110*a* and a second coil conductor 110*b* disposed on upper and lower layers so as to face each other and to be spaced apart from each other.

Here, the first coil conductor 110*a* and the second coil conductor 110*b* may be inter-layer connected through vias (not illustrated) to form one coil or to each form a separate coil, whereby the first coil conductor 110*a* and the second coil conductor 110*b* may be electromagnetically coupled to each other. In this case, the coil component 100, according to the exemplary embodiment, may be operated as a common mode filter (CMF) in which when currents having the same direction are applied to the first coil conductor 110*a* and the second coil conductor 110*b*, the magnetic fluxes combine to increase common mode impedance, and when currents having opposing directions flow in the first coil conductor 110*a* and the second coil conductor 110*b*, the magnetic fluxes are offset to decrease differential mode impedance.

The corner portions above the insulating layer 120 may be provided with external terminals 150 having a predetermined thickness and electrically connected to the coil conductors 110.

In detail, the external terminal 150 may be formed to have an L-shape, in which a horizontal part 150*a* having a wide area in direct contact with a mounting substrate, and a vertical part 150*b* extended into an interior of the insulating layer 120 are coupled to each other, and the coil conductor 110 may be connected to the vertical part 150*b*.

For example, one end of the first coil conductor 110*a* may be connected to the vertical part 150*b* of one of the external terminals 150 formed in four corner portions, and the other end of the first coil conductor 110*a* may be connected to the vertical part 150*b* of an external terminal opposed thereto. A connection structure of the second coil conductor 110*b* may also be the same as that described above.

The magnetic member 130 disposed on the insulating layer 120 may be formed to fill an empty space between the external terminals 150.

The magnetic member 130 may be a magnetic resin complex in which magnetic powder particles are dispersed in an adhesive polymer resin, and as a result, the magnetic member 130 may become the movement path of the magnetic flux together with the magnetic substrate 140. Here, for the magnetic powder particles, a nickel (Ni) based ferrite, a Ni—Zn based ferrite, a Ni—Zn—Cu based ferrite, or the like having high permeability may be used.

As a content ratio of the magnetic powder included in the magnetic member 130 is increased, permeability is increased, but specific gravity of a resin is decreased. Thus, in a case in which the magnetic powder particles are excessively mixed in the magnetic member 130 in order to increase permeability, adhesion between the magnetic member 130 and the insulating layer 120 may be decreased. As a method of complementing the adhesion, the coil component 100, according to the exemplary embodiment, may include a magnetic core 130*a* protruding from a surface of the magnetic member 130, in particular, a surface bonded to the insulating layer, and inserted into the insulating layer 120.

Figure 3:
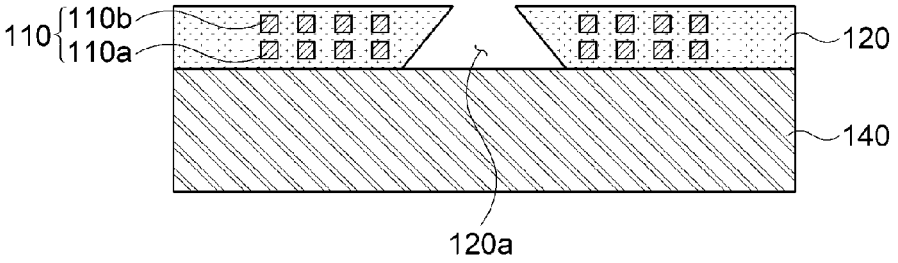
FIG. 3 is a cross-sectional view of the coil component before a magnetic member is formed in the coil component of FIG. 1.

FIG. 3 is a cross-sectional view illustrating the coil component before the magnetic member 130 is formed.

Referring to FIG. 3, a cavity 120*a* into which the magnetic core 130*a* is to be inserted may be formed in a central portion of the insulating layer 120. The cavity 120*a* may be formed by using a method which is widely known in the art to which the present disclosure pertains, such as etching, photolithography, or the like.

The magnetic member 130 may be formed by coating a magnetic resin paste on the insulating layer 120 as well as an interior of the cavity 120*a* at the same thickness as that of the external terminal 150 and then sintering. Thus, the magnetic member 130 and the magnetic core 130*a* may become a single structure which is integrally formed, and the magnetic core 130*a* may be formed of the same magnetic resin complex as the magnetic member 130.

The cavity 120*a* may have a trapezoidal shape in which a width thereof is increased toward the other surface of the insulating layer 120 (a lower surface of the insulating layer 120 in FIG. 2); for instance, as the cavity 120*a* becomes distant from the magnetic member 130, the magnetic core 130*a* filled in the cavity 120*a* may also be formed in the trapezoidal shape in which a lower width L2 thereof is greater than an upper width L1 thereof. Thus, the magnetic core 130*a* may serve as a so-called anchor to structurally prevent the magnetic member 130 from being separated from the insulating layer 120. As a result, the adhesive strength between the insulating layer 120 and the magnetic member 130 is increased, whereby high reliability of the product may be guaranteed.

The magnetic core 130*a* may be formed to protrude from the central portion of the magnetic member 130, and as a result, the coil conductor 110 may have a coil pattern wound around the magnetic core 130*a*.

Thus, the magnetic flux generated from the coil conductor 110 may continuously flow along a loop leading to the magnetic member 130, the magnetic core 130*a*, and the magnetic substrate 140 without a discontinuous section. As a result, according to the exemplary embodiment, an occurrence of leakage of magnetic flux is suppressed, and thus the coil component having an improved electromagnetic coupling degree and impedance characteristics as compared to the related art may be provided.

Further, as the magnetic core 130*a* is formed in the anchor structure, the magnetic flux more smoothly flows in the vicinity of an edge A of the magnetic core 130*a* which is closest to the coil conductor 110, whereby an impedance increase effect may be obtained.

Meanwhile, due to the magnetic core 130*a* having the anchor structure, an area occupied by the magnetic core 130*a* in the insulating layer 120 may be increased toward the lower portion of the insulating layer 120. Thus, a mounting area of the coil conductors disposed on the lower layer, for instance, the first coil conductor 110*a* which is close to the magnetic substrate 140 may be reduced. As a result, the number of coil turns of the first coil conductor 110*a* may be decreased, which causes a decrease in inductance.

Figure 4:
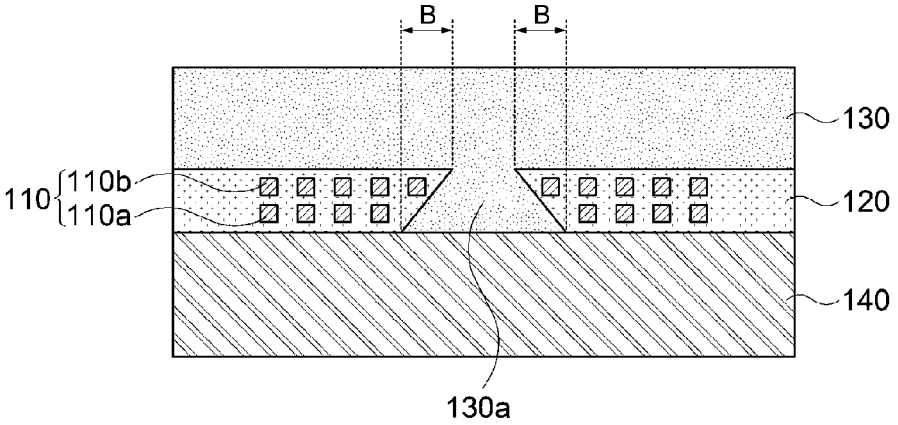
FIG. 4 is a cross-sectional view of a coil component according to another embodiment in the present disclosure.

FIG. 4 is a cross-sectional view of a coil component according to another exemplary embodiment. According to the present exemplary embodiment, in order to solve the above-mentioned problem, the number of coil turns of the coil conductor which is close to the magnetic member 130, for instance the second coil conductor 110*b* disposed on the upper layer, is greater than that of the first coil conductor 110*a*. The number of coil turns may be increased by printing the first coil conductor 110*a* one more turn in a space B between a lower end of the magnetic core 130*a* and an upper end thereof.

As such, the decreased inductance may be complemented by increasing the number of turns of the coil conductor 110 on the upper layer (the second coil conductor 110*b*) by as much as the reduced number of turns of the coil conductor 110 on the lower layer (the first coil conductor 110*a*).

Figure 5:
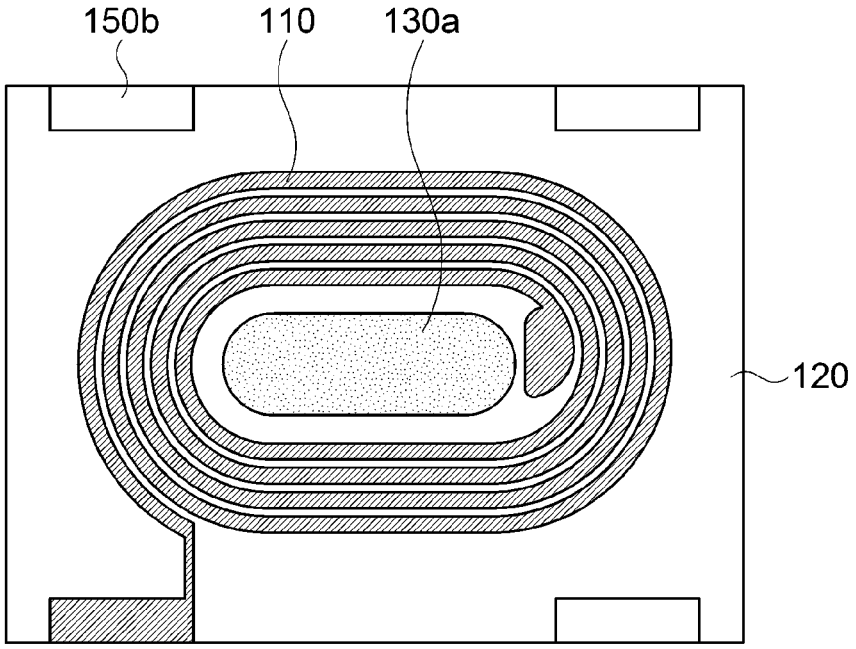
FIG. 5 is a view illustrating a modified example of a magnetic core included in the present disclosure and a plan view of the magnetic core including coil conductors.

FIG. 5 is a view illustrating a modified example of the magnetic core 130*a* included in the exemplary embodiment and a plan view of the magnetic core 130*a* including the coil conductor 110.

As illustrated in FIG. 5, the magnetic core 130*a* may have an elongated oval shape when viewed from the top. However, the shape of the magnetic core 130*a* is not limited thereto, and the magnetic core 130*a* may have various shapes such as a circular shape, an oval shape, a quadrangular shape, and the like when viewed from the top, depending on a spiral shape of the coil conductor 110. For instance, the magnetic core 130*a* may have a planar shape corresponding to a shape and a size of a core portion so as to fill the inside of the core portion of the coil conductor 110 when viewed from the top.

Meanwhile, a ratio of the lower width L2 of the magnetic core 130*a* to the upper width L1 thereof may be set to an appropriate value taking into account a correlation between the inductance and the anchor effect.

Figure 6:
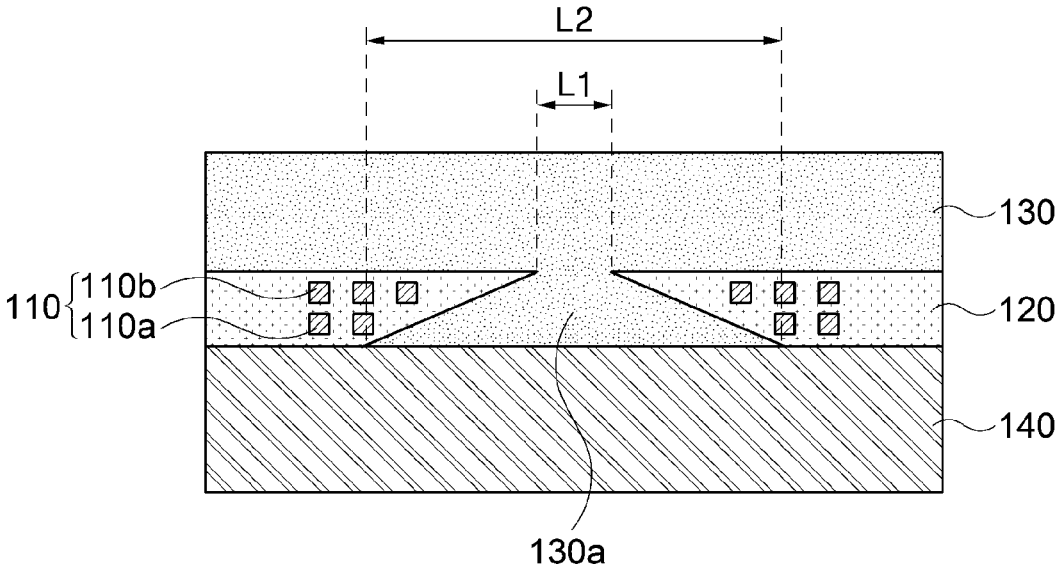
FIG. 6 is a cross-sectional view illustrating an exemplary embodiment in which a lower width of the magnetic core included in the present disclosure is five times greater than an upper width thereof.

FIG. 6 is a cross-sectional view illustrating an exemplary embodiment in which the lower width L2 of the magnetic core 130*a* is approximately five times greater than the upper width L1 thereof. In this case, an inclined angle of a side wall of the magnetic core 130*a* is increased, and thus the adhesive strength is increased by the anchor effect, but the area occupied by the magnetic core 130*a* is excessively increased, and thus the number of coil turns of the first coil conductor 110*a* and the second coil conductor 110*b* may be reduced.

Therefore, the ratio of the lower width L2 of the magnetic core 130*a* to the upper width L1 thereof may be set to a suitable value in the range in which the inductance is not significantly decreased by the decrease in the number of coil turns while having the anchor effect, and a value of the ratio may be more than one time to four times or less.

As set forth above, according to exemplary embodiments, the separation of the magnetic member from the insulating layer may be structurally prevented by a magnetic core of an anchor structure having the trapezoidal shape.

In addition, the adhesive strength between the insulating layer and the magnetic member may be improved without decreasing inductance by increasing the number of coil turns of the coil conductors disposed on the upper layer.

While exemplary embodiments have been shown and described above, it will be apparent to those skilled in the art that modifications and variations could be made without departing from the scope of the present invention as defined by the appended claims.

What is claimed is:

1. A coil component comprising:

an insulating layer in which coil conductors are embedded; and a magnetic member in contact with one surface of the insulating layer and having a magnetic core protruding from the magnetic member, wherein the magnetic core protrudes into a cavity of the insulating layer and has a width that increases toward the other surface of the insulating layer, wherein a cross-section of the cavity at the other surface has a width greater than that of a cross-section of the cavity at the one surface, wherein the magnetic core includes a same magnetic resin as the magnetic member, and wherein the magnetic core fills at least a central region of the cross-section of the cavity at the other surface.

2. The coil component of claim 1, wherein the magnetic core is formed at a central portion of the magnetic member and the coil conductors have coil patterns wound around the magnetic core.

3. The coil component of claim 1, wherein a ratio of a width of the magnetic core at the surface in contact with the insulating layer to a width of the magnetic core at the other surface of the insulating layer is more than one time to four times or less.

4. The coil component of claim 1, wherein the magnetic core has any one of an elongated oval shape, a circular shape, an oval shape, and a quadrangular shape when viewed from the top.

5. The coil component of claim 1, wherein the magnetic member is a magnetic resin complex formed by dispersing magnetic powder particles in a polymer resin.

6. The coil component of claim 1, further comprising a magnetic substrate disposed in contact with the other surface of the insulating layer.

7. The coil component of claim 1, wherein the coil conductors comprise a first coil conductor and a second coil conductor disposed on upper and lower layers and spaced apart from each other, and the number of coil turns of the second coil conductor disposed on the upper layer is greater than the number of coil turns of the first coil conductor disposed on the lower layer.

8. The coil component of claim 1, further comprising external terminals formed in corner portions above the insulating layer and electrically connected to the coil conductors.

9. The coil component of claim 1, wherein the width increases from the one surface to the other surface.

* * * * *